US005208925A

United States Patent [19]

Edlund

[11] Patent Number: 5,208,925

[45] Date of Patent: May 11, 1993

[54] SHEET FOR INCLINED INFANT MATTRESS

[76] Inventor: Edith M. Edlund, 10430 NE. 112th St., Kirkland, Wash. 98033

[21] Appl. No.: 891,157

[22] Filed: May 28, 1992

[51] Int. Cl.[5] ..... A47D 15/00

[52] U.S. Cl. ..... 5/424; 5/494; 128/872; 128/875

[58] Field of Search ..... 5/485, 486, 494, 424; 128/872, 874, 875

[56] References Cited

U.S. PATENT DOCUMENTS

| | | | |
|---|---|---|---|
| 2,439,101 | 4/1948 | Rogers | 2/114 |
| 2,589,596 | 3/1952 | Auer | 2/69.5 |
| 2,702,385 | 2/1955 | Goldberg | 2/69.5 |
| 2,989,753 | 6/1961 | Burner | 2/69.5 |
| 3,093,132 | 6/1963 | Bailey | 128/134 |
| 3,521,309 | 7/1970 | Evans | 5/336 |
| 3,987,505 | 10/1976 | Hickey | 5/494 X |
| 4,597,121 | 7/1986 | Bouma | 5/494 |
| 4,657,005 | 4/1987 | Williamson | 128/875 |
| 4,802,244 | 2/1989 | McGrath-Saleh | 5/494 X |
| 4,858,025 | 8/1989 | Cramer | 128/872 |
| 4,862,535 | 9/1989 | Roberts | 5/494 X |
| 4,911,105 | 3/1990 | Hocum | 5/424 X |
| 4,989,286 | 2/1991 | Tucker | 5/494 X |
| 5,014,376 | 5/1991 | Doran et al. | 5/431 |

FOREIGN PATENT DOCUMENTS

| | | | |
|---|---|---|---|
| 2615081 | 5/1987 | France | 5/494 |

*Primary Examiner*—Michael F. Trettel
*Attorney, Agent, or Firm*—Craine & Vance

[57] ABSTRACT

Apparatus defining a sling for holding a child on an inclined mattress within a crib, the apparatus having a front portion, a back portion, and means for attaching the sling to the crib. Alternatively, the back portion comprises a modified conventional fitted sheet which is attached to the mattress instead of to the crib.

8 Claims, 4 Drawing Sheets

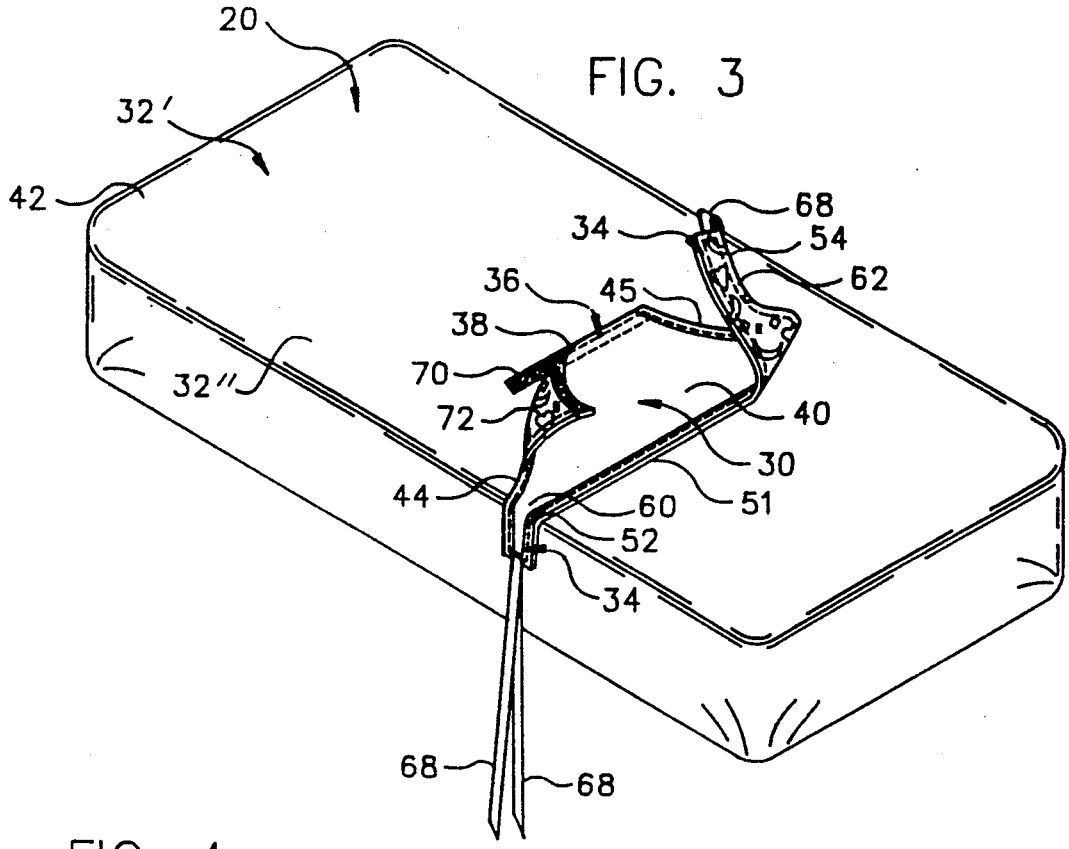
FIG. 3
FIG. 4
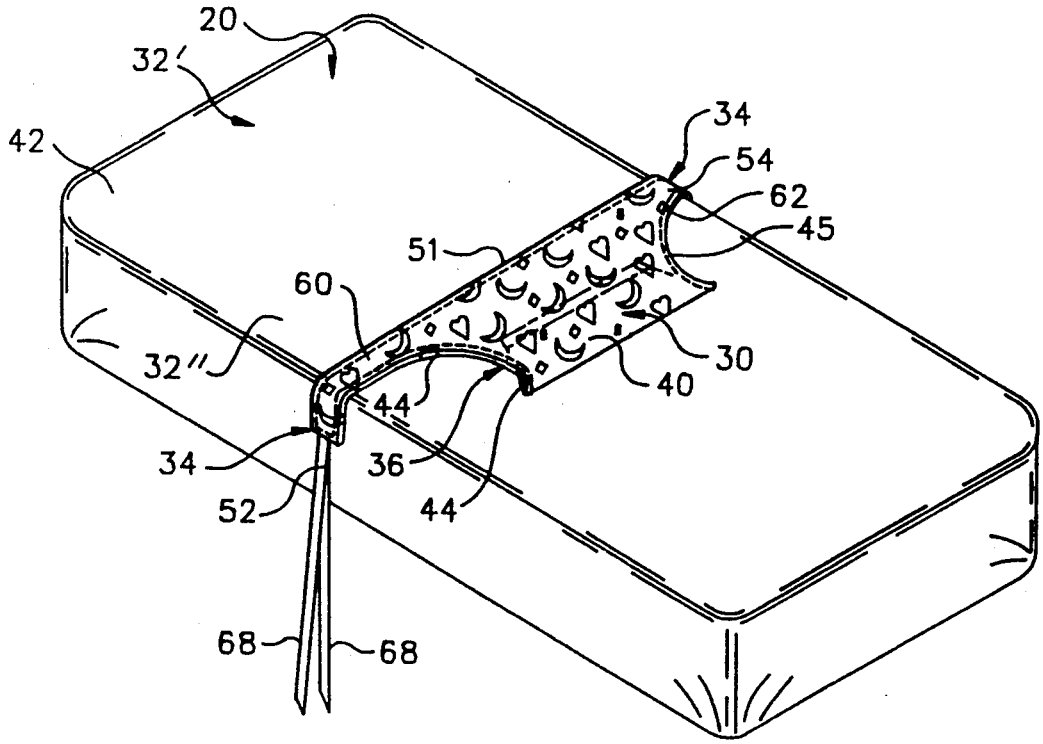

SHEET FOR INCLINED INFANT MATTRESS

COPYRIGHT NOTICE

® Copyright 1992, James R. Vance. All rights reserved.

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyrights whatsoever.

TECHNICAL FIELD

This invention relates to apparatus and processes for safely holding and retaining an infant or child on an inclined mattress. More particularly, the present invention relates to apparatus and processes employing a sheet which is designed to be secured to the frame or slats of a crib to prevent an infant or child from sliding down an inclined mattress. The infant or child is also prevented from turning over while positioned within the invention.

BACKGROUND ART

Medical doctors often suggest that an infant or child should be propped-up or inclined while awake and/or while asleep. During times of illness, such inclination often reduces various symptoms and increases the child's comfort. For example, an inclined posture often helps a child sleep during times when the child has a head cold and his or her sinuses are draining.

Various methods may be used to place the infant or child in an inclined position. For example, pillows may be propped-up underneath the child in an increasingly elevated manner. This method, however, has some drawbacks. Pillows are typically very soft and assume the contour of a weighted, overlying object. Consequently, there is a danger that a small infant or child may suffocate if the child's face becomes directed toward the pillow. The flexibility of pillows also may not give the foundational strength required to support the infant or child in a given position. It is very easy for an infant or child to roll over and slide off the pillows. If this was to occur, the child might fall off the bed, couch, chair, etc., or become entangled within the posts, side bars, spindles, or slats of the crib. The degree of danger depends upon the underlying structure that the pillows are placed upon and upon the relative elevation of such a structure above the floor.

Another method of propping-up an infant or child is to cause a crib mattress to be inclined. Some parents or caretakers place pillows or other bedding beneath one end of the crib mattress, thus elevating one end of the mattress over the other. Alternatively, many cribs are designed specifically to allow one end of the mattress foundation to be elevated above the other. A standard fitted sheet is placed over the crib mattress. In both of these methods, the infant or child is directly supported by the crib mattress. It is of course assumed that the crib mattress is placed within a crib framework. Such methods, however, are not without problems.

Since the mattress is inclined, gravity tends to urge the child toward the lowest end of the mattress. If you have ever camped on an inclined hill, you will know the disconcerting feeling of sleeping on an incline without any additional support to maintain your position other than the friction between your clothing and the underlying surface. Similar discomfort is most likely experienced by infants and small children placed upon an inclined, smooth, slippery crib mattress. Bumper pads or pillows may be placed around the slatted sides of the crib. When the child finally reaches the lowermost end of the mattress, the bumper pads or pillows attempt to prevent the child from becoming entangled within the slats.

The following disclosures relate to various known types of infant sheet or clothing devices that may be relevant to this invention: Rogers (U.S. Pat. No. 2,439,101; issued Apr. 6, 1948); Auer (U.S. Pat. No. 2,589,596; issued Mar. 18, 1952); Goldberg (U.S. Pat. No. 2,702,385; issued Feb. 22, 1955); Burner (U.S. Pat. No. 2,989,753; issued Jun. 27, 1961); Bailey (U.S. Pat. No. 3,093,132; issued Jun. 11, 1963); Evans (U.S. Pat. No. 3,521,309; issued Jul. 21, 1970); Bouma (U.S. Pat. No. 4,597,121; issued Jul. 1, 1986); McGrath-Saleh (U.S. Pat. No. 4,802,244; issued Feb. 7, 1989); Tucker (U.S. Pat. No. 4,989,286; issued Feb. 5, 1991); and Doran et al. (U.S. Pat. No. 5,014,376; issued May 14, 1991).

The inventor believes that the cited disclosures taken alone or in combination neither anticipate nor render the present invention obvious. These citations do not constitute an admission that such disclosures are relevant or material to the present claims. Rather, these citations relate only to the general field of the disclosure and are cited as constituting the closest art of which the inventor is aware.

DISCLOSURE OF INVENTION

The present invention is designed to achieve the foregoing objectives and to overcome the previously stated difficulties and disadvantages. The present invention further provides an extremely simple, reusable, adjustable sheet that can be effectively used on an inclined mattress in almost any crib having vertical slats.

To achieve the above-stated general and specific objectives, the present invention comprises the combination of a front portion, a back portion, and means for attaching the front portion and the back portion to the crib. In essence, the front portion defines a front side of a sling. The back portion defines a back side of a sling.

In the first embodiment of the invention, when the sling is laid out flat, within a common plane, the sling generally has an hourglass configuration with the front portion being attached to the back portion along a common juncture generally located at a narrowest width of the sling. When placed within a common plane, the sides of the front portion converge toward the common juncture. Similarly, the sides of the back portion converge toward the common juncture.

Since the present invention can be used as both a sling and a bed sheet, the back portion is large in size than the front portion. The reduction in size of the front portion is important since it is the front portion that will be folded over the child, and sufficient room must be allocated for comfortable movement of the child within the present restraint or sling.

A wide variety of means may be used to attach the front portion and the back portion of the sling to the crib. For example, the shape of the front portion and of the back portion may be cut to form opposed front straps and back straps, respectively. The front straps extend outwardly from the respective sides of the front portion. The back straps extend outwardly from the respective sides of the back portion.

In other words, the sides of the front portion diverge away from the common juncture gradually to form the front straps, and the front straps are gradually tapered inwardly from the wider front portion. Similarly, the sides of the back portion diverge away from the common juncture gradually to form the back straps, and the back straps gradually taper inwardly from the wider back portion.

Thus configured, the back straps can be removably attached or secured to the crib. This may be accomplished by providing the ends of the back straps with a VELCRO hook-and-loop fastening system, a button and button hole, a snap, a hook and eye, a clasp, at least two elongated ties, or the like, which enable the back straps to be removably attached and secured to the crib. In the preferred embodiment the back straps are secured to vertical posts, bars, spindles, or slats of the headboard or sides of the crib.

The child is placed upon the back portion with his or her legs located on each side of the common juncture. The front portion is then folded over the child and a portion of the back portion of the invention to form a sling. The front straps are then removably attached to the crib in a manner similar to that used to secure the back straps to the crib. For example, the outermost ends of the front straps may be provided with a VELCRO hook-and-loop fastening system, a button and button hole, a snap, a hook and eye, a clasp, at least two elongated ties, or the like, which enable the front straps to be removably attached and secured to the crib. Thus configured, the sling is placed in an operative position to form an enclosure into which the child is held and retained.

When the child is in the sling, one leg is located on each side of the common juncture and the front portion is stretched taut across the posterior or stomach of the child. When so positioned within the sling, the sling prevents the child from sliding down the inclined mattress. The front portion and front straps also define a barrier that prevents the child from turning over. This in turn prevents the child from becoming entangled in loose ties and/or bedding. The weight of the child against the sling causes the front straps and back straps to remain taut. The gradual tapering, shape, and configuration of the front portion and front straps, and of the back portion and back straps, cause the invention to have relatively wide, secure, and sturdy members close to the child. The present invention removes the proximity of any thin ropes or cords away from the child, thereby creating a more safe environment for the child.

Although the present invention may be made of any appropriate desired material, it is intended that materials common in infant bedding be used. For example, it is very common for absorbent cotton prints to be used for infant bedding.

Since the front portion is folded over the back portion of the invention, if a cotton print is used, the uppermost surfaces of the back portion and of the front portion will be noticeably different. The difference is due to the manufacture and printing of the cotton material.

To alleviate this problem, the material forming the front portion may be reversed or inverted with respect to the material forming the back portion, as seen when the front portion and the back portion are placed within a common plane. The front portion may then be sewn or otherwise attached to the back portion along the common juncture. Thus configured, the uppermost surfaces of the front portion will match the uppermost surfaces of the back portion when the child is held within the sling.

The joining of these two pieces of fabric along the common juncture imparts added benefits to the invention. For example, the doubled or tripled layers of cloth required to properly join the fabrics imparts greater strength and rigidity to the common juncture of the sling. The extra layers of material function almost like a batten to urge the sides of the sling apart. Consequently, a greater amount of support is imparted to the child when held within the sling. In essence, the child has a stronger seat to sit within.

In an alternative embodiment, the front portion and front straps are generally identical to those described above. The back portion still functions as a back side of the sling. However, the back portion does not have back straps. Instead, a modified, conventional fitted sheet serves as the back portion of the invention. The fitted sheet is removably attached to the mattress and encloses the entire upper surface of the mattress. The front portion is attached to the back portion along a common juncture.

The front portion is preferably removably attached to the back portion along the common juncture. For example, a VELCRO hook-and-loop fastening system may be used at the common juncture, with the soft loop portion being secured to the fitted sheet or back portion. This design enables the front portion to be optionally removed and the back portion used as a conventional mattress sheet. Thus the second embodiment of the present invention can be used both as a regular, conventional sheet for a crib mattress, and then be instantly modified to form the above-described sling.

These and other objects and advantages of the present invention will become more readily apparent upon reading the following disclosure and referring to the attached drawings.

BRIEF DESCRIPTION OF DRAWINGS

FIG. 3 is an isometric view of a second embodiment of the invention as taught herein, with the back portion being formed from a fitted crib sheet.

FIG. 4 is an isometric view of the second embodiment shown in FIG. 3, with the seat portion raised into an operational position.

Figure 1:
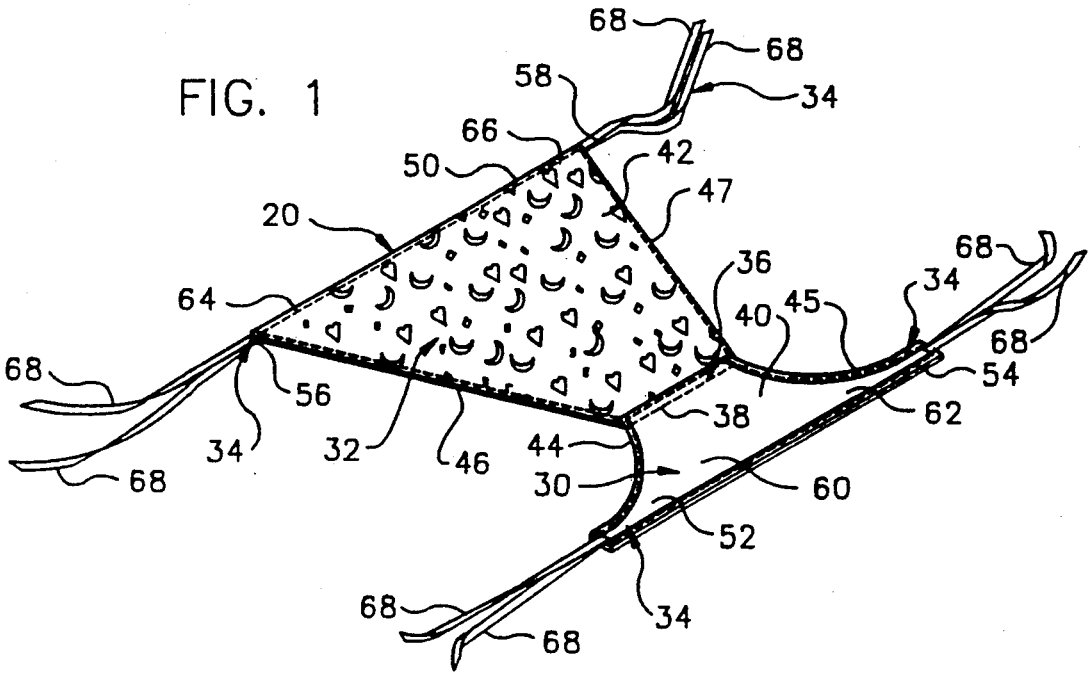
FIG. 1 an isometric view of a first embodiment of the invention as taught herein, with the seat portion lowered to illustrate the construction of the sheet.

One should understand that the drawings are not necessarily to scale and the elements are sometimes illustrated by graphic symbols, phantom lines, diagrammatic representations, and fragmentary views. In certain instances, the inventor may have omitted details which are not necessary for an understanding of the present invention or which render other details difficult to perceive.

BEST MODE FOR CARRYING OUT THE INVENTION

Referring to the drawings, wherein like numerals indicate like parts, the apparatus of the present invention generally comprises a harness, seat, or sling 20 into which an infant or child 22 may be placed. It is intended that the apparatus be placed upon an inclined mattress 24 which is retained within a conventional crib 26 having vertical side posts, bars, spindles, or slats 28.

Figure 2:
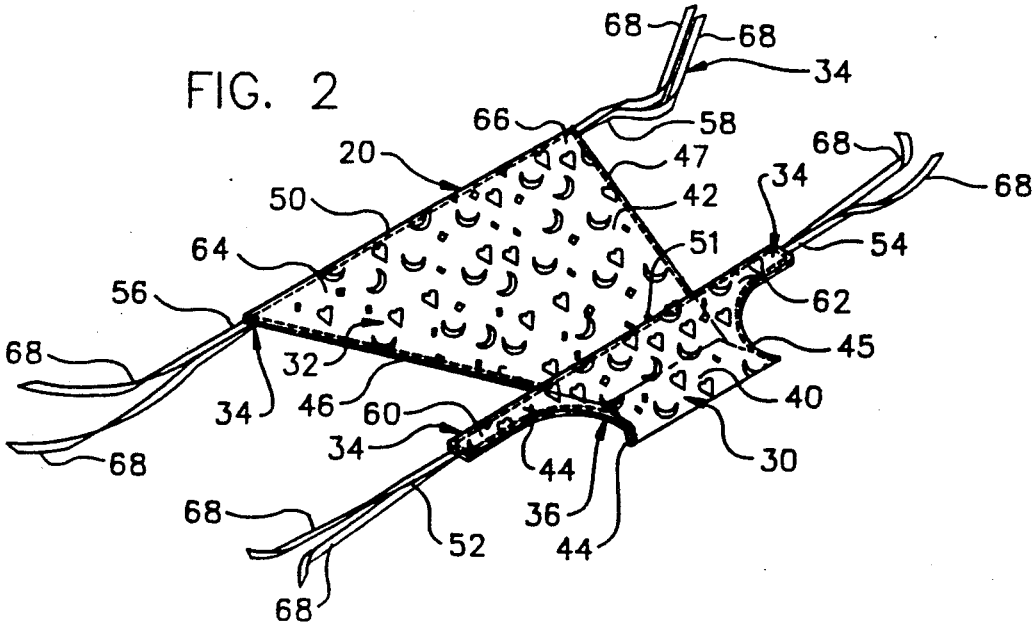
FIG. 2 is an isometric view of the first embodiment shown in FIG. 1, with the seat portion raised into an operational position.
Figure 5:
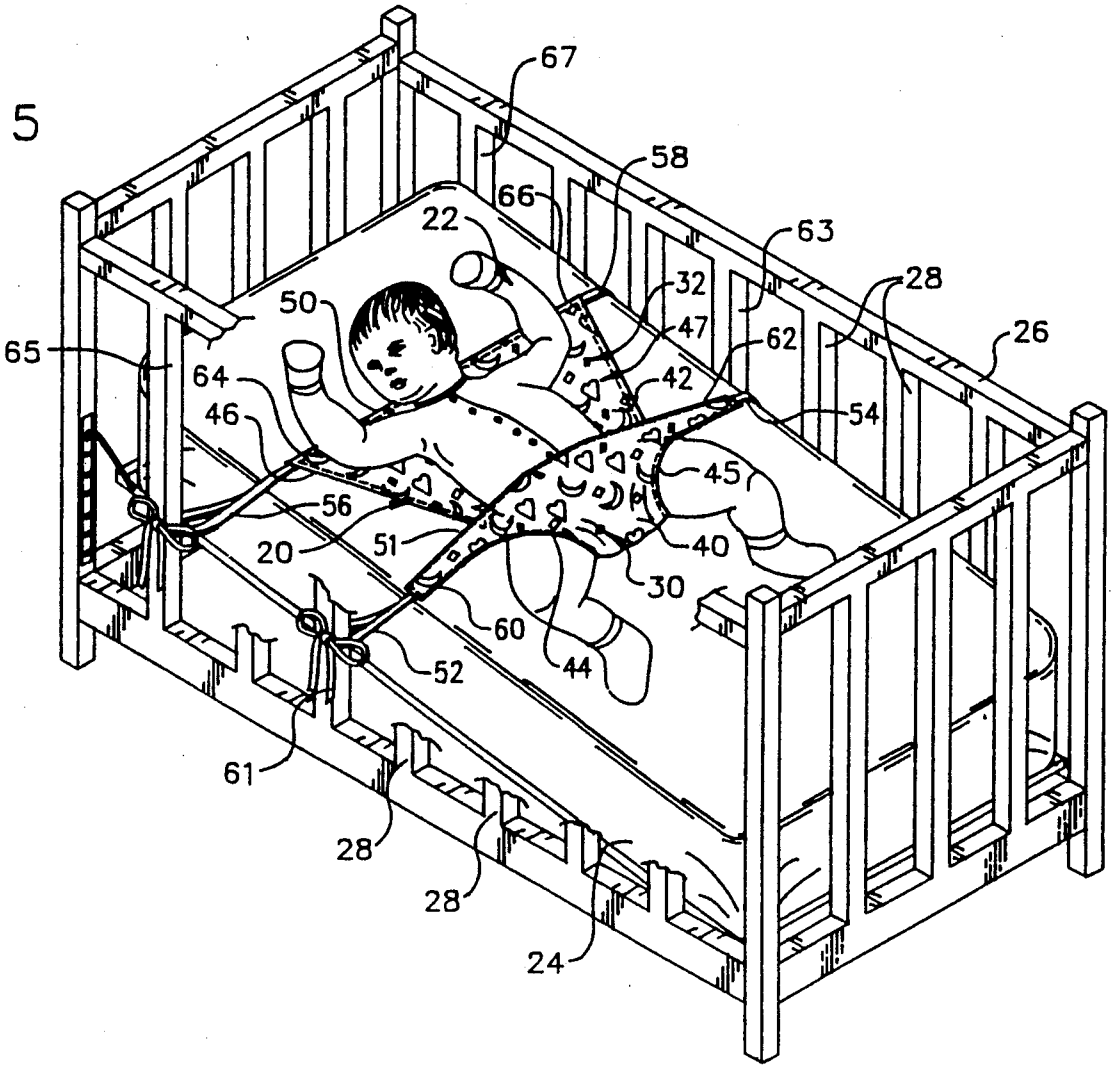
FIG. 5 is an isometric view of the first embodiment as shown in FIGS. 1 and 2 secured in an operational position to vertical slats of a crib.

As illustrated in FIGS. 1, 2 and 5, a first embodiment of the invention generally comprises a front portion 30, a back portion 32, and means 34 for attaching front portion 30 and back portion 32 to crib 26.

Front portion 30 and back portion 32 are attached together along a common juncture 36 to form sling 20. Front portion 30 defines a front side of sling 20. Back portion 32 defines a back side of sling 20. When front portion 30 and back portion 32 are stretched out within a common plane, they generally impart an hourglass configuration to sling 20. The narrowest width of sling 20 serves as common juncture 36 between front portion 30 and back portion 32.

Common juncture 36 may comprise simply a continuous area within a single piece of material that forms sling 20. Alternatively, common juncture 36 may comprise a seam 38 which physically joins two or more different fabric segments 40 and 42 which respectively define front portion 30 and back portion 32.

If front portion 30 and back portion 32 are made from separate fabric segments 40 and 42, the right side of fabric segment 40 can be reversed and/or inverted with respect to the right side of fabric segment 42. As a result, when sling 20 is placed in an operational position, as illustrated in FIG. 2, with front portion 30 being folded over back portion 32, a pattern that is printed upon fabric segments 40 and 42 will match. Alternatively, fabric segments 40 and 42 may be formed of different fabric or sheet materials and/or have different printed patterns thereon.

The joining of fabric segments 40 and 42 along common juncture 36 gives sling 20 added strength and rigidity. For example, if common juncture 36 comprises folded sewn seam 38 of two or more layers of fabric, the overlapping layers of fabric segments 40 and 42 function much like a batten to urge the sides of sling 20 apart. Consequently, a greater amount of support is imparted to the child 22 when held within sling 20. In essence, the child 22 has a stronger seat to sit within.

As best seen in FIG. 1, when front portion 30 and back portion 32 are placed flat within a common plane, sides 44 and 45 of front portion 30 and sides 46 and 47 of back portion 32 generally converge toward common juncture 36. Such a convergence is provided to accommodate placement of the child 22 within sling 20. One leg of the child 22 is placed on each side of common juncture 36. The width of common juncture 36 should be sufficient to comfortably support the seat of the child 22 without causing chaffing or rubbing against the legs of the child 22.

Although back portion 32 need only be large enough to properly position common juncture 36 with respect to crib 26, it is preferred that back portion 32 be large enough to accommodate placement of the back and head of the child 2 thereon.

As seen in FIGS. 1 and 2, back portion 32 may be provided with an upper edge 50 which is generally straight. Thus configured, back portion 32 generally has the appearance of an isosceles trapezoid or that of a truncated triangle. Alternatively, upper edge 50 may comprise any desired configuration which accomplishes the same objectives as herein described.

Since front portion 30 is going to be folded over the child 22 and/or over a portion of back portion 32 during use in its operational position, it is preferred that back portion 32 be larger in size than front portion 30.

During use, a front edge 51 and front portion 30 will be folded over and urged against the stomach, chest, and/or back of the child 22 to retain the child 22 in a generally stationary position. Front edge 51 of front portion 30 will not extend over the face or head of the child 22.

As explained above, means 34 for attaching front portion 30 and back portion 32 to crib 26 are also provided. For example, attaching means 34 may comprise a pair of opposed front straps 52 and 54 and a pair of opposed back straps 56 and 58 which enable respective sides 44 and 45 of front portion 30 and sides 46 and 47 of back portion 3 to be attached or secured to the vertical head slates or side slats 28 of crib 26. In essence, front strap 52 secures corner 60 to slat 61, front strap 54 secures corner 62 to slat 63, back strap 56 secures corner 64 to slat 65, and back strap 58 secures corner 66 to slat 67. Front straps 52 and 54 and back straps 56 and 58 extend outwardly from the distal ends or corners 60 and 62 of front portion 30 and from the distal ends or corners 64 and 66 of back portion 32, respectively.

It is preferred that sides 44 and 45 of front portion 30 diverge outwardly away from common juncture 36 toward corners 60 and 62 to form gradually tapered front straps 52 and 54. Similarly, sides 46 and 47 of back portion 32 preferably diverge outwardly away from common juncture 36 toward corners 64 and 66 to gradually form back straps 56 and 58. If desired, back straps 56 and 58 may be tapered.

Means for securing straps 52, 54, 56, and 58 to slats 61, 63, 65, and 67, respectively, can be provided at the terminal end of each strap 52, 54, 56, and 58. For example, each such strap may further comprise a hook-and-loop fastening system, a button and button hole, a snap, a hook and eye, a clasp, or one or more elongated ties 68, or the like, which enable the strap to be removably secured to a vertical side slat 28 of crib 26.

The first embodiment of the invention enables selectable placement of sling 20 upon mattress 24 within crib 26. Sling 20 may be moved up or down the inclined mattress 24 and secured to successive appropriate head or side slats 28 of crib 26. For example, prior to the operation of the invention, back straps 56 and 58 are secured to head slats or to side slats 65 and 67 of crib 26.

The child 22 is then placed upon back portion 32 such that common juncture 36 is located between the legs of the child 22. The child 22 may be placed upon back portion 32 either facing downward or facing upward as desired.

Front portion 30 is then raised and folded over and urged against the stomach, chest, or back of the child 22 to form an enclosure wherein the child 22 is to be retained. Front straps 52 and 54 are then secured to slats 61 and 63, respectively, located on the opposite sides of crib 26 as illustrated in FIG. 5. Thus positioned, the child 22 is retained within sling 20 and has one leg located on each side of common juncture 36. Sling 20 prevents the child 22 from sliding down the inclined mattress 24. Front portion 30 and front straps 52 and 54 define a barrier to prevent the child 22 from turning over.

Placement of front straps 52 and 54 on vertical slats 61 and 63 of crib 26 can be adjusted to increase or decrease the amount of force exerted upon the child 22 to retain the child 22 in a given position. For example, front straps 52 and 54 may be raised from mattress 24 and secured higher up on vertical slats 61 and/or 63 to give the child 22 more room to maneuver. Front straps 52 and 54 may also be lowered toward or below the upper surface of mattress 24 to adjustably restrict movement of the child 22.

Figure 6:
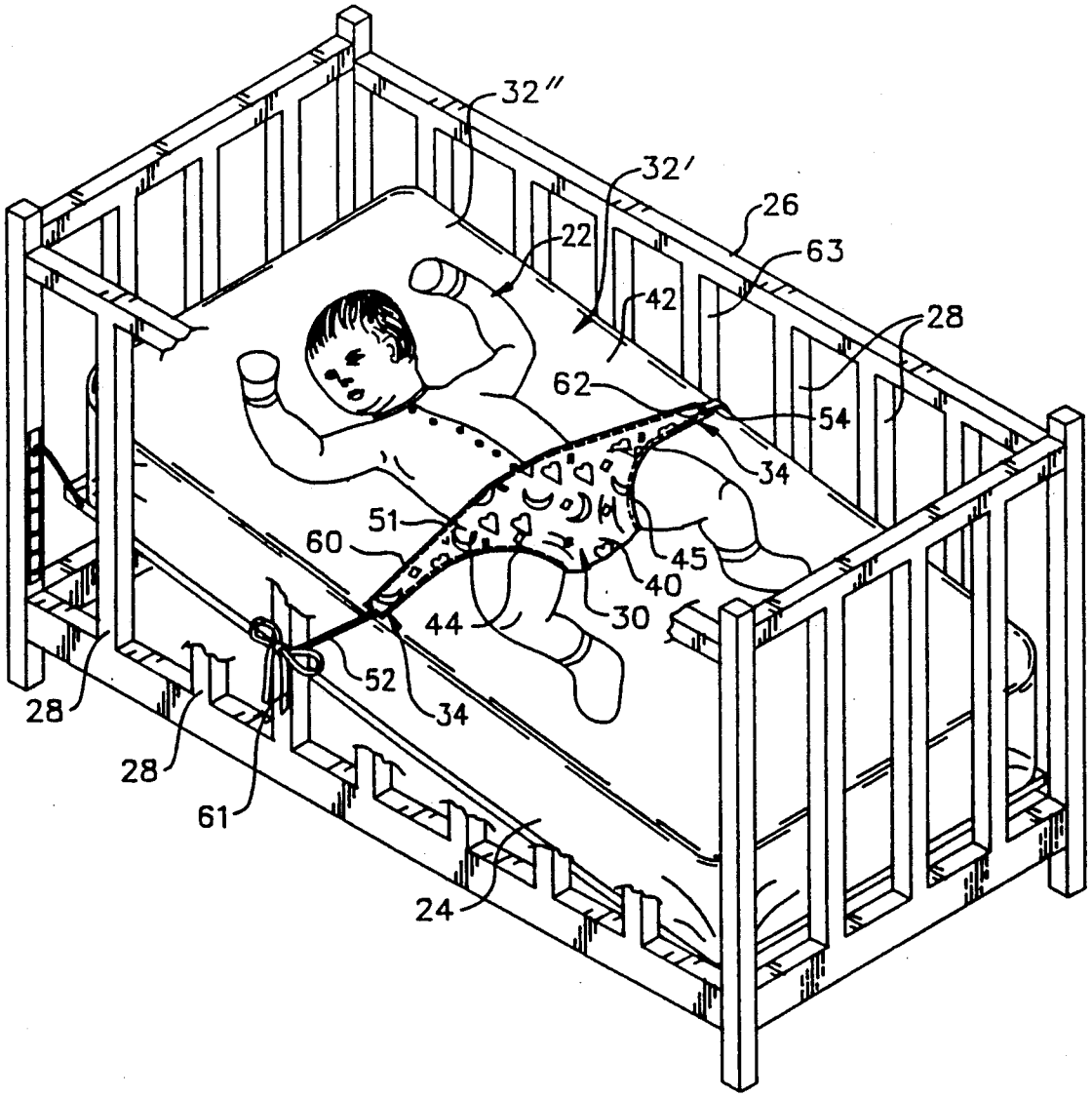
FIG. 6 is an isometric view of the second embodiment as shown in FIGS. 3 and 4 secured in an operational position to a mattress and to the vertical slats of a crib.

As illustrated in FIGS. 3, 4, and 6, in a second or alternative embodiment, sling 20 generally comprises front portion 30, back portion 32', and means 34 for attaching front portion 30 to crib 26 and attaching back portion 32' to mattress 24. Front portion 30 of the second embodiment is basically identical to front portion 30 of the first embodiment. However, since back portion 32' comprises a modified standard fitted sheet 32'', front portion 30 may be removably secured to back portion 32' along common juncture 36. This enables the invention to be used either as sling 20, or alternatively, to remove front portion 30 and thereby permit back portion 32' to be used as a conventional fitted mattress sheet 32''.

As stated above, back portion 32' of the second embodiment is preferably formed from a modified conventional fitted mattress sheet 32''. The modification is the addition of means for removably securing front portion 30 thereto along the portion referred to as common juncture 36. In the preferred embodiment, such securing means comprises a VELCRO hook-and-loop fastening system having soft looped segment 70 and hooked segment 72. Soft looped segment 70 is sewn or otherwise attached to a desired location, preferably near the center of crib mattress 24. Hooked segment 72 is sewn or otherwise attached to the common juncture 36 area of front portion 30. Alternatively, buttons and button holes, snaps, hooks and eyes, clasps, ties, zippers, or the like, may be used to removably secure front portion 30 to back portion 32'.

Although it is preferred that front portion 30 be removable, it is also contemplated and taught herein that front portion 30 may be permanently secured to back portion 32' along common juncture 36.

When in its operational position, front straps 52 and 54 of front portion 30 are attached to slats 61 and 63 of crib 26 as described above. Back portion 32' is not attached directly to crib 26, but rather is fitted and thereby secured to crib mattress 24. With the exception that back portion 32' is secured directly to crib mattress 24, the second embodiment is used in the same manner as described above for the first embodiment of the invention.

The means and construction disclosed herein are by way of example and comprise primarily the preferred form of putting the invention into effect. Although the drawings depict preferred and alternative embodiments of the invention, other embodiments have been described within the preceding text. One skilled in the art will appreciate that the disclosed device may have a wide variety of shapes and configurations. Additionally, persons skilled in the art to which the invention pertains might consider the foregoing teachings in making various modifications, other embodiments, and alternative forms of the invention.

It is, therefore, to be understood that the invention is not limited to the particular embodiments or specific features shown herein. To the contrary, the inventor claims the invention in all of its forms, including all alternatives, modifications, equivalents, and alternative embodiments which fall within the legitimate and valid scope of the appended claims, appropriately interpreted under the Doctrine of Equivalents.

INDUSTRIAL APPLICABILITY

The present invention may be used at home, at a hospital, or at a day-care center with equal success and effectiveness. The invention is extremely simple, reliable, and is easily installed, used, removed, and laundered. The invention is compact, functional, unobtrusive, efficient, reusable, durable, rugged, is easily constructed, and is inexpensive and economical to manufacture. Traditional or nontraditional means for attachment may be used (i.e., use of a VELCRO hook-and-loop fastener system, simple ties, snaps, buttons, hook and eyes, clasps, etc.) The present invention not only increases the speed and simplifies the procedure to place and hold an infant or child on an inclined mattress, this invention also prevents the child from rolling over and becoming entangled in the straps or other bedding. The first embodiment of the invention accomplishes the foregoing objectives with a minimum amount of fabric, which in turn reduces the amount of material that would be laundered after use. The second embodiment of the invention allows for modification of a conventional fitted crib sheet with a detachable front sling portion to accomplish the same objectives.

What is claimed is:

1. An apparatus for holding a child having two legs on an inclined mattress held within a crib, said apparatus comprising:

(a) a front portion defining a front side of a sling;

(b) a back portion defining a back side of said sling, said sling having a generally hourglass configuration when said front portion and said back portion are placed within a common plane, said front portion being attached to said back portion along a common juncture generally located at a narrowest width of said sling, when placed within said common plane, sides of said front portion generally converging toward said common juncture, when placed within said common plane, sides of said back portion generally converging toward said common juncture, said back portion being larger in size than said front portion; and (c) means for attaching said front portion and said back portion to the crib, said attaching means having opposed front straps extending outwardly from respective sides of said front portion, said attaching means having opposed back straps extending outwardly from respective sides of said back portion, sides of said front portion diverging away from said common juncture to gradually form said front straps, sides of said front straps being gradually tapered from said front portion, sides of said back portion diverging away from said common juncture to gradually form said back straps, said back straps being removably attached to the crib, said front portion being folded over a portion of said back portion and said front straps being removably attached to the crib to place said sling in an operative position to form an enclosure into which the child may be held, when said sling is in said operative position the child having one leg located on each side of said common juncture, said sling preventing the child from sliding down the inclined mattress when in said operative position, said front portion and said front straps defining a barrier to prevent the child from turning over when said sling is in said operative position, each of said front straps further comprising at least two elongated ties which enable said front straps to be removably secured to the crib.

2. An apparatus for holding a child having two legs on an inclined mattress held within a crib, said apparatus comprising:

(a) a front portion defining a front side of a sling;

(b) a back portion defining a back side of said sling, said sling having a generally hourglass configuration when said front portion and said back portion are placed within a common plane, said front portion being attached to said back portion along a common juncture generally located at a narrowest width of said sling, when placed within said common plane, sides of said front portion generally converging toward said common juncture, when placed within said common plane, sides of said back portion generally converging toward said common juncture, said back portion being larger in size than said front portion; and (c) means for attaching said front portion and said back portion to the crib, said attaching means having opposed front straps extending outwardly from respective sides of said front portion, said attaching means having opposed back straps extending outwardly from respective sides of said back portion, sides of said front portion diverging away from said common juncture to gradually form said front straps, sides of said front straps being gradually tapered from said front portion, sides of said back portion diverging away from said common juncture to gradually form said back straps, said back straps being removably attached to the crib, said front portion being folded over a portion of said back portion and said front straps being removably attached to the crib to place said sling in a operative position to form an enclosure into which the child may be held, when said sling is in said operative position the child having one leg located on each side of said common juncture, said sling preventing the child from sliding down the inclined mattress when in said operative position, said front portion and said front straps defining a barrier to prevent the child from turning over when said sling is in said operative position, each of said back straps further comprising at least two elongated ties which enable said back straps to be removably secured to the crib.

3. An apparatus for holding a child having two legs on an inclined mattress held within a crib, said apparatus comprising:

(a) a front portion defining a front side of a sling;

(b) a back portion defining a back side of said sling, said back portion further defining a fitted mattress sheet removably attached to the mattress, said front portion being attached to said back portion along a common juncture, sides of said front portion converging toward said common juncture; and (c) means for attaching said front portion to the crib, said attaching means having opposed front straps extending outwardly from respective sides of said front portion, sides of said front portion diverging away from said common juncture to gradually form said front straps, sides of said front straps being gradually tapered from said front portion, said front portion being folded over a portion of said back portion and said front straps being removably attached to the crib to place said sling in an operative position to form an enclosure into which the child may be held, when said sling is in said operative position the child having one leg located on each side of said common juncture, said sling preventing the child from sliding down the inclined mattress when in said operative position, said front portion and said front straps defining a barrier to prevent the child from turning over when said sling is in said operative position.

4. The apparatus of claim 3, wherein each of said front straps further comprises a hook-and-loop fastening system, a button and button hole, a snap, a hook and eye, or a clasp which enables said front straps to be removably secured to said crib.

5. The apparatus of claim 3, wherein each of said front straps further comprises at least two elongated ties which enable said front straps to be removably secured to said crib.

6. The apparatus of claim 3, wherein said front portion is removably attached to said back portion at said common juncture.

7. The apparatus of claim 6, wherein said front portion is removably attached to said back portion at said common juncture by use of a hook-and-loop fastener system.

8. An apparatus for holding a child having two legs on an inclined mattress held within a crib, said apparatus comprising:

(a) a front portion defining a front side of a sling;

(b) a back portion defining a back side of said sling, said back portion further defining a fitted mattress sheet removably attached to the mattress, said front portion being attached to said back portion along a common juncture, sides of said front portion converging toward said common juncture; and (c) means for attaching said front portion to the crib, said attaching means having opposed front straps extending outwardly from respective sides of said front portion, sides of said front portion diverging away from said common juncture to gradually form said front straps, sides of said front straps being gradually tapered from said front portion, said front portion being folded over a portion of said back portion and said front straps being removably attached to the crib to place said sling in an operative position to form an enclosure into which the child may be held, when said sling is in said operative position the child having one leg located on each side of said common juncture, said sling preventing the child from sliding down the inclined mattress when in said operative position, said front portion and said front straps defining a barrier to prevent the child from turning over when said sling is in said operative position said back portion having an uppermost surface revealing a printed pattern thereon, said front portion also having an uppermost surface revealing printed pattern thereon when said front portion is folded over said back portion to assume said operative position.

* * * * *